United States Patent [19]

Byding et al.

[11] Patent Number: 4,496,181

[45] Date of Patent: Jan. 29, 1985

[54] METHOD AND A DEVICE FOR LIFTING AND LOWERING OF A LOAD

[75] Inventors: Otto Byding, Granvägen; Rolf Ströberg, Låangsjövägen, both of Sweden

[73] Assignee: ITT Industries, Inc., New York, N.Y.

[21] Appl. No.: 366,440

[22] Filed: Apr. 7, 1982

[30] Foreign Application Priority Data

May 7, 1981 [SE] Sweden ..... 8102854

[51] Int. Cl.[3] ..... B66C 1/14

[52] U.S. Cl. ..... 294/78 R; 294/83 R

[58] Field of Search ..... 294/83 R, 78 R, 66 R, 294/75, 83 A, 83 AB, 84, 1; 24/230.5, 232 R, 232 G, 241 P, 241 TC, 242; 59/93, 84, 85, 86

[56] References Cited

U.S. PATENT DOCUMENTS 4,151,708 5/1979 Smetz ..... 294/83 R 4,227,733 10/1980 Haglund ..... 294/83 R

*Primary Examiner*—James B. Marbert

*Attorney, Agent, or Firm*—John T. O'Halloran; Peter R. Ruzek; Mary C. Werner

[57] ABSTRACT

The invention concerns a method and a device for lifting and lowering of a load. The load is provided with a short lifting chain which in its turn is connected to a guiding wire. A lifting hook connected to a lifting device is arranged to be guided along the guiding wire to the lifting chain.

When the guiding wire is slacked the lifting chain will engage a slot in the lifting hook and the load can be lifted up.

7 Claims, 2 Drawing Figures

METHOD AND A DEVICE FOR LIFTING AND LOWERING OF A LOAD

BACKGROUND OF THE INVENTION

The invention concerns a method and a device for lifting and lowering respectively a load which preferably shall be moved to and from a space below the ground or the floor, under a water surface or similar spaces where access is difficult.

When handling a load submersed in water, for instance a submersible pump, a chain is normally used which is attached to the load and suspended above the water level. When the load should be lifted or lowered the lifting device must be attached repeatedly which demands shackles or other devices for repeatedly attaching.

This method of handling the load is, however, troublesome and time consuming. In practice it is therefore common to angle for the load by help of a lifting hook where the safety lock has been put out of order. This method means, however, a considerable safety risk as the load may loosen from the hook during swinging.

Another problem, which is especially important in sewage pump stations, is that the original lifting chain of the pump unit corrodes at the water level and therefore must be replaced at certain intervals.

SUMMARY OF THE INVENTION

The purpose of this invention is therefore to obtain a method and a device which solves the problems mentioned to quickly, simply and securely lift and lower a load where the latter is out of reach and possibly also hidden under a water level.

This method comprises the step of using a guiding wire connected to a chain having links attached to the load for guiding a hook connected to a lifting device having a lifting wire along the guiding wire and the chain for connection and disconnection of the hook to and from the load. The device comprises lifting means for removable connection to the chain for lifting the load, and a guiding wire having one end connected to the chain and the other end disposed at the working level for guiding the lifting means along the guiding wire and the chain for removable connection to the load.

BRIEF DESCRIPTION OF THE DRAWING

The invention is described more closely below with reference to the accompanying drawing, in which.

DESCRIPTION OF THE PREFERRED EMBODIMENT

In the FIGS., 1 stands for a lifting chain attached to a load 2. 3 stands for a guiding wire for a lifting hook 4. The latter is provided with a slot 5 and a support 6. 7 stands for a lifting device connected to a pulley block or the like.

Figure 1:
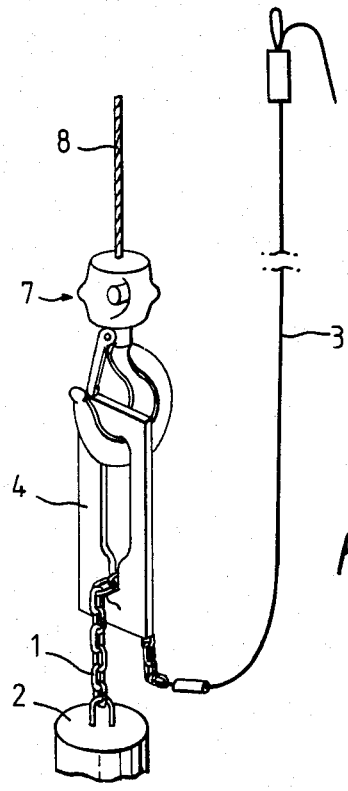
FIG. 1 shows a device according to the invention.
Figure 2:
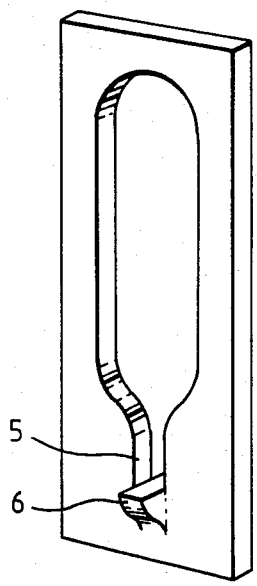
FIG. 2 shows the details of an enlarged portion of FIG. 1.

As can be seen from FIG. 1 the load 2, for instance a submersible pump, is provided with a short lifting chain 1. To this lifting chain a guiding wire 3 is connected, the other end of which is suspended at the working level.

The guiding wire is thus not intended for lifting and is preferably a thin wire of a non-corrosive material.

If the load takes its lowered position and shall be lifted, the guiding wire 3 is stretched and the lifting hook 4, which is connected to a lifting device 7, is entered on the wire. The lifting hook 4 is then guided along the wire down to the chain 1. When the lifting hook has entered the chain, the wire is slacked thus bringing the chain to fold around the lifting hook, sliding down into the slot 5 and take the position shown in FIG. 1. In this position a link of the chain is positioned in the slot 5, the width of which only slightly exceeds the thickness of the link. The links on each side of the link in the slot are turned 90° with regard to the middle link and are thus prevented from sliding through the slot. In order to diminish the stress on the link in the slot, the latter is provided with a shoulder supporting most of the link.

When the chain has been locked in the slot the load is lifted by help of the lifting device 7 connected to the lifting hook 4. The guiding wire 3 has already fulfilled its mission and accompanies the chain during the lifting.

The lowering takes place in a similar way. When the load has reached its lowered position hanging in the lifting device 7, the lifting wire 8 is slacked, while the guiding wire 3 is stretched. The chain 1 is thereby loosened from the slot 5, thereby permitting the lifting hook 4 to be slid away from the chain and guided along the guiding wire up to the working level, while the load remains in its lowered position. It should be observed that the lifting device 7 is provided with a security lock which prevents it from sliding out of the hole in the lifting hook 4.

It has previously been mentioned that the guiding wire 3 always remains in its position, while the lifting device 7 may be used for several different loads, for instance several submersible pumps in a pumping station or possibly, for several pumping stations. The guiding wire is therefore preferably made of a non-corrosive material. The cost is very low compared with making the whole lifting chain of this material.

Especially significant for the invention is the easy handling. The guiding wire 3 is thus used for guiding the lifting device 7 down to the load and also serves as a maneuvering device for the lifting hook 4 when the lifting chain 1 should be attached to or loosened from the hook. No other maneuvering devices which complicate the handling are thus needed.

We claim

1. A method of moving a load by a lifting device, the load having a weight supporting member attached thereto, comprising the steps of:

attaching a guiding wire element of a strength insufficient to carry the load to the weight supporting member;

sliding a guide member, which is connected to the lifting device and slidably joined to the guiding wire element, to the weight-supporting member; and maneuvering the guiding wire for engaging the guide member with the weight-supporting member in a locked position and for disengaging the guide member from the weight supporting member in an unlocking position.

2. The method as claimed in claim 1 wherein the maneuvering step includes stretching the guiding wire element to permit the guide member to become locked in the weight-supporting member.

3. An arrangement for moving a load having a weight supporting element attached thereto by a lifting device comprising:

a guide member attached to the lifting device; and a guiding wire element of a strength insufficient to carry the load connected to the weight supporting member and extending through said guide member, said guiding wire element being operative for sliding by guiding the guide member to and from the weight supporting member and for maneuvering the guide member onto the weight supporting member in a locking position and off of the weight supporting member in an unlocking position.

4. The arrangement of claim 3 wherein said guiding element has an opening through which the lifting device is engaged.

5. The arrangement of claim 3 wherein said weight supporting member is a linked chain.

6. The arrangement as claimed in claim 5 wherein the opening has a section which forms a slot having a width slightly larger than the thickness of said chain and smaller than the width of the links of said chain to engage the chain in said locking position.

7. The arrangement as claimed in claim 6 wherein said slot has a shoulder at one end in order to support one of the links of said chain when the chain is in a locking position.

* * * * *